United States Patent [19]

Karg

[11] Patent Number: 4,729,663

[45] Date of Patent: Mar. 8, 1988

[54] CYCLONE MIXER FOR THE CONTINUOUS MIXING OF PULVERULENT SUBSTANCES WITH LIQUIDS

[75] Inventor: Roland Karg, Montana, Switzerland

[73] Assignee: Ytron Dr. Karg GmbH, Affalterbach, Fed. Rep. of Germany

[21] Appl. No.: 863,841

[22] Filed: May 16, 1986

[30] Foreign Application Priority Data

May 17, 1985 [DE] Fed. Rep. of Germany ..... 3517879

[51] Int. Cl.[4] ..... B01F 7/26; B01F 15/02

[52] U.S. Cl. ..... 366/165; 366/171; 366/181; 366/183; 366/264; 366/304; 366/305

[58] Field of Search ..... 366/76, 98, 64, 65, 366/150, 163, 164, 167, 168, 171, 194, 195, 196, 262–265, 305–307, 315, 317; 241/101 B; 415/90, 116; 417/420, 430, 431

[56] References Cited

U.S. PATENT DOCUMENTS

| | | | |
|---|---|---|---|
| 423,285 | 3/1890 | Smith et al. | 366/264 |
| 1,354,489 | 10/1920 | Johnson | 366/264 |
| 1,768,956 | 7/1930 | Johnson | 366/264 |
| 3,606,270 | 9/1971 | Zimmerly | 366/263 |
| 4,062,526 | 12/1977 | Green | 366/171 |
| 4,075,089 | 2/1978 | Saari et al. | 366/264 X |
| 4,136,971 | 1/1979 | Varlamov et al. | 366/171 X |
| 4,511,256 | 4/1985 | Karg et al. | 366/305 X |

*Primary Examiner*—Timothy F. Simone

*Attorney, Agent, or Firm*—Fleit, Jacobson, Cohn & Price

[57] ABSTRACT

In a cyclone mixer for the continuous mixing of pulverulent substances with liquids, with a charging mechanism for the pulverulent substances and with a mixing chamber positioned below it and into whose upper region issues a tangential suction tube and which is provided in the lower region with a pump impeller and a dispersing apparatus surrounding the same and into whose lower region issues an outlet, it is provided according to the invention that the dispersing apparatus is constructed as a fixed lamellar ring, which is provided with uniformly circumferentially distributed baffle lamellas extending substantially radially outwards and whose inner portions immediately adjacent to the radial outer boundary of the impeller. In the case of an extremely simple construction, this apparatus ensures that despite the oppositely influencing parameters of high dispersion level and high throughput, a qualitatively and quantitatively very high efficiency is achieved.

4 Claims, 7 Drawing Figures

CYCLONE MIXER FOR THE CONTINUOUS MIXING OF PULVERULENT SUBSTANCES WITH LIQUIDS

Figure 1:
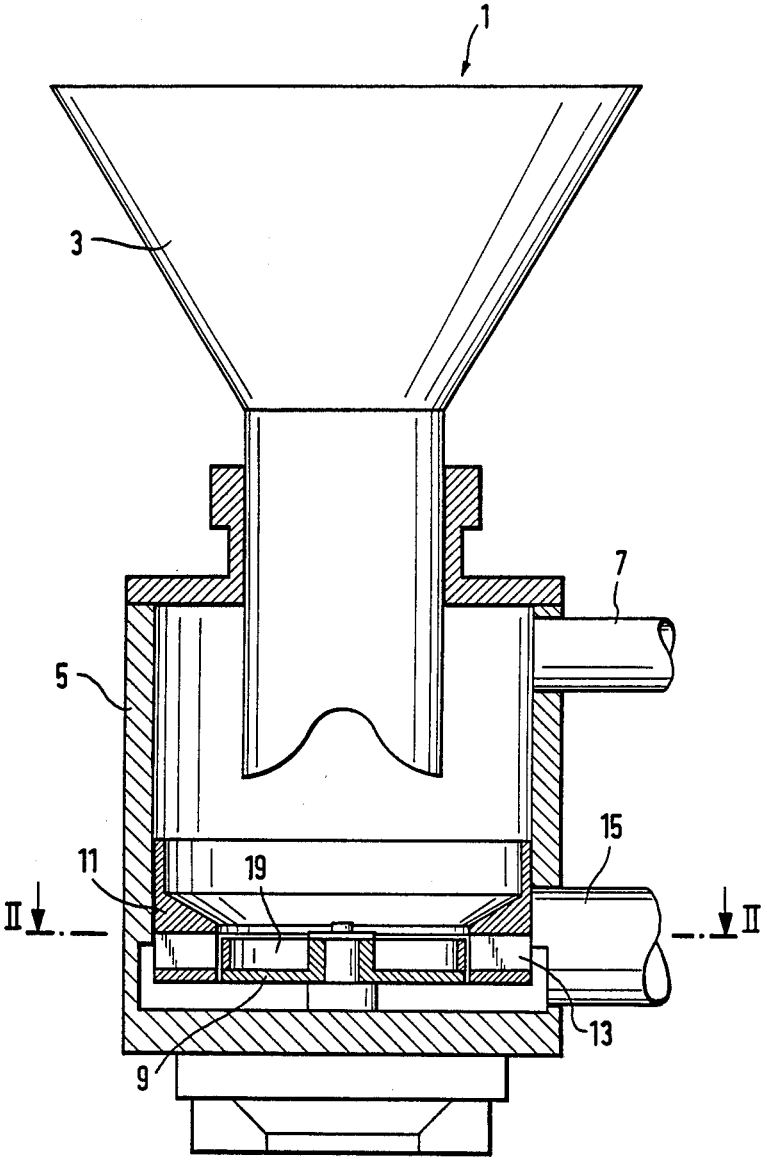

The present invention relates to a cyclone mixer for the continuous mixing of pulverulent substances with liquids, with a charging mechanism for pulverulent substances and with a mixing chamber positioned below said mechanism and in whose upper region is provided a tangential suction tube for liquids and in whose lower region is provided a pump impeller with a dispersing mechanism surrounding the same, the pump impeller serving to produce a centrifugal flow, which in its lower region is guided through the dispersing mechanism and is removed from the mixing chamber through an outlet arranged in the lower region of said mixing chamber.

Several means are known, which can be used for solving the problem of bringing difficulty decomposable or digestible thickeners and stabilizers into a colloidal solution/dispersion or suspension.

For example a dispersing apparatus is known, in which the substances in question are processed batchwise. In this apparatus, in which the shear forces necessary for dispersion are produced by a gear rim, it is disadvantageous that it is not possible to achieve a controllable passage sequence of the pulverulent substance through the dispersing apparatus. Dry product fractions exist, which unnecessarily pass several times through the dispersing apparatus, so that their structure is excessively stressed and is broken up. However, other powder fractions are not or are less frequently passed through the dispersing head, so that they are either not or are inadequately decomposed for them to be effective. this apparatus also does not make it possible to obtain exactly reproducible results.

An apparatus is also known in which the difficulty decomposable thickeners and/or stabilizers are discontinuously mixed to a more or less satisfactory extent with the liquid in a mixer. The inadequately wetted dry product is then colloidally decomposed and deagglomerated in an in-line dispersing apparatus. Although the forces passage through the dispersing apparatus leads to an adequately well dispersed end product, the batch is not sufficiently homogeneous, because the apparatus is charged with lumps and agglomerates. Thus, the dispersed end product has a non-uniform concentration. In order to achieve an adequately homogeneous batch, it is necessary to repeat the dispersing process. For this purpose, the batch must be delivered in a circuit via a container using a jet mixer (for uniform suspension purposes). This repeated product circulation leads to a risk of the solution being overstressed. The molecular chain of the substances to be decomposed is broken, so that the viscosity and the linked binding force are significantly reduced.

In the case of thickeners, a further mixer is known in which the dry products are sucked into the liquid via an injector. The limit of use of this apparatus occurs when using not readily flowing powders or if high concentrations are required. Such an injector makes it possible to wet primary particle agglomerates, but a colloidal decomposition of each individual particle is not possible.

In a further mixer, dry substances are delivered in dosed form into a dissolving chamber from a charging mechanism. The dry products are forcibly brought together with the quantity-regulated liquid in the dissolving chamber. Although this leads to high concentrations in the in-line process, hereagain the dry products are not adequately decomposed. This construction does not even permit dispersion.

An improvement is achieved with the mixer according to DE-OS 32 43 671 constituting a continuous apparatus for mixing pulverulent substances with liquids and which makes it possible to reliably process particularly difficultly decomposable thickeners and stabilizers to a homogeneous colloidal solution, dispersion or suspension. In this apparatus on the charging mechanism flow guidance surfaces are arranged between the charging tube and the mixing chamber wall in such a way that a downwardly directed flow deflection is brought about in the rotation direction of the tangentially entering liquid. The high dispersion action of this concentration is particularly achieved through a rotary paddle wheel being positioned radially outside the pump impeller, the rotation direction and angular velocity of pump impeller and rotating paddle wheel coinciding. At least one rotary and one fixed gear rim are inserted, without radial gaps, between the pump impeller and the rotating paddle wheel, the teeth of the two rims being in each case constructed in prong-like manner, being upwardly directed in one rim and downwardly directed in the other.

In the case of this mixer, particular importance is attached to the effective design of the dispersing mechanism. Due to the comprehensive measures provided for achieving a high dispersion efficiency, it is necessary to make certain economies with respect to the level of the maximum volume flow obtained at the outlet.

The problem of the present invention is to provide a cyclone mixer of the aforementioned type which, despite the oppositely influencing parameters of high dispersion level on the one hand and high throughput on the other, provides a qualitatively and quantitatively very high efficiency and which has an extremely simple construction.

According to the basic principle of the invention the dispersing mechanism of the cyclone mixer is constructed as a lamellar ring fixed relative to the pump impeller and which has uniformly circumferentially distributed impact or baffle lamellas extending substantially radially outwards and whose inner end portions are positioned immediately adjacent to the radial outer boundary of the pump impeller.

Such an apparatus solves the problem in that on the one hand an excellently dispersed solution is obtained at the mixing chamber outlet and on the other the volume flow there is very high. Simultaneously the constructional design is extremely simple. This advantage is inter alia obtained in that the baffle lamellas preferably have a planar construction. The still not adequately dispersed dry products hurled out of the vicinity of the pump impeller are hurled against an inner wall of a lamella or several times against the inner walls of two adjacent lamellas, so that an agglomerate is broken up and can be adequately wetted.

In the basic form of the inventive apparatus, it is provided that the baffle lamellas extend substantially radially. As a function of the consistency of the substance to be dispersed the lamellas can be pivoted by an acute angle $\alpha$ with respect to the radial direction. In the case of extremely difficulty decomposable dry products, the baffle lamellas are pivoted from the radial direction by an acute angle $\alpha$ in the rotation direction of the pump impeller. As a result the particles hurled out of the impeller region strike the impact lamellas at an acute angle, so that the dispersion efficiency is increased.

If more easily decomposable thickeners and/or stabilizers are to be processed in a mixer, the baffle lamellas of the interchangeable lamellar ring slope by an acute angle $\alpha$ out of the radial direction and counter to the rotation direction. In this case, agglomerated particles are still hurled under a very acute angle against the lamella walls, so that an adequate dispersing effect is still obtained, but simultaneously an increased throughput is achieved.

According to a preferred embodiment, in the region adjacent to the pump impeller, the baffle lamellas extend over the impeller base disc, to which the impeller vanes are fixed.

This leads to a constant transfer of the solution flowing from the pump impeller into the lamellar ring in the lower region of the mixing chamber.

In the basic form of the inventive apparatus the lamellar ring and pump impeller are arranged substantially at the same level. In particular if the lamellar ring has a greater height extension than the pump impeller, it is possible to vary the height position between the lamellar ring and the impeller. According to a preferred embodiment, the base ring of the lamellar ring on which the baffle lamellas are fixed is then positioned lower than the pump impeller. This embodiment can lead to an additional dispersing effect in that the centrifugal flow from the higher pump impeller must flow down over a type of step onto the lower base ring of the lamellar ring.

As the baffle lamellas according to the invention are substantially radially aligned and as the volume flow flowing out between the lamellas passes out of the lamellar ring substantially radially, it is favourable from the fluidic standpoint to orient the mixing chamber outlet substantially in the same direction as the lamellas.

It can also be advantageous from the fluidic standpoint to position the radially inner portions of the baffle lamellas at a higher level than the radially outer portion. Preferably the radially inner portions of the lamellas are on the same plane as the pump impeller.

It can finally be an important criterion for achieving adequate dispersion for the distance between adjacent baffle lamellas to be smaller than their radial extension. Particularly in the case of difficulty decomposable dry products said feature can be of considerable significance, because it is always important to provide an adequate number of impact surfaces.

According to a preferred development of the invention the lamellar ring is followed by a further pump impeller arranged coaxially below the first pump impeller. Following the passage through the lamellar ring, the powder—liquid mixture firstly reaches the further pump impeller before leaving the mixing chamber. This measure has the advantage that a faster throughput can be achieved. Mixing chamber sticking is also prevented in the case of very hygroscopic powder types.

The invention is described in greater detail hereinafter relative to non-limitative embodiments and the attached drawings, wherein show:

FIG. 1, a vertical section through a cyclone mixer.

Figure 2:
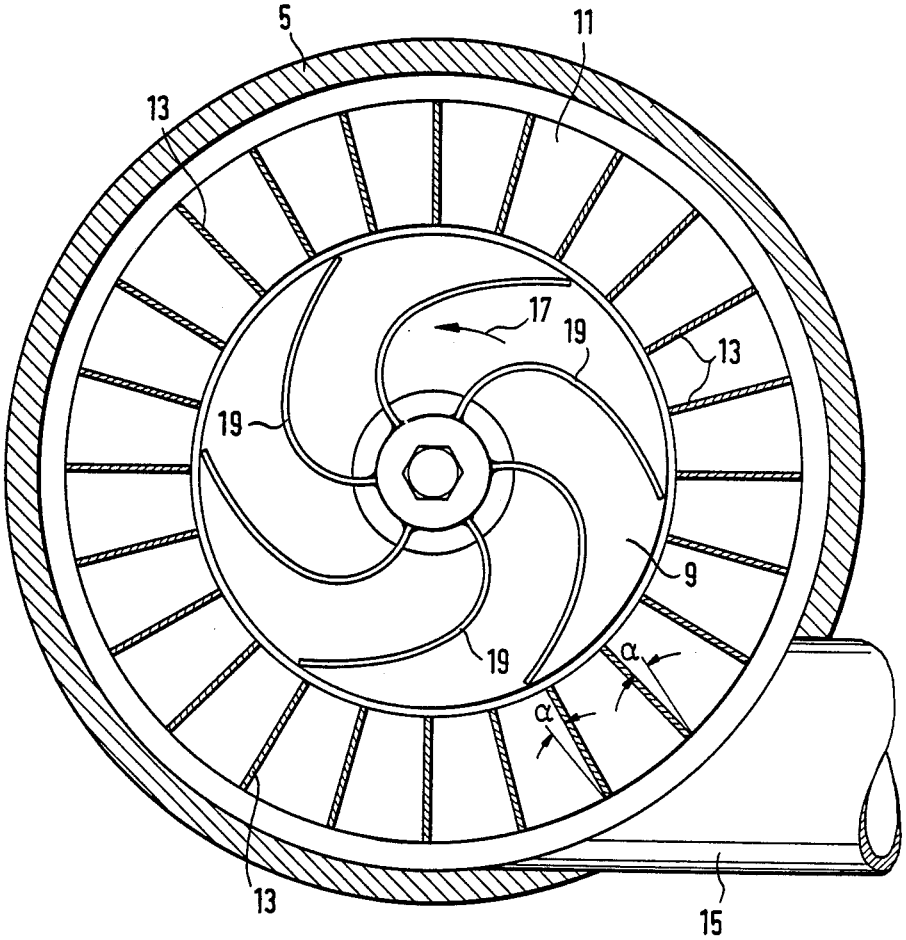

FIG. 2, a sectional view of the cyclone mixer along the II—II of FIG. 1.

Figure 3:
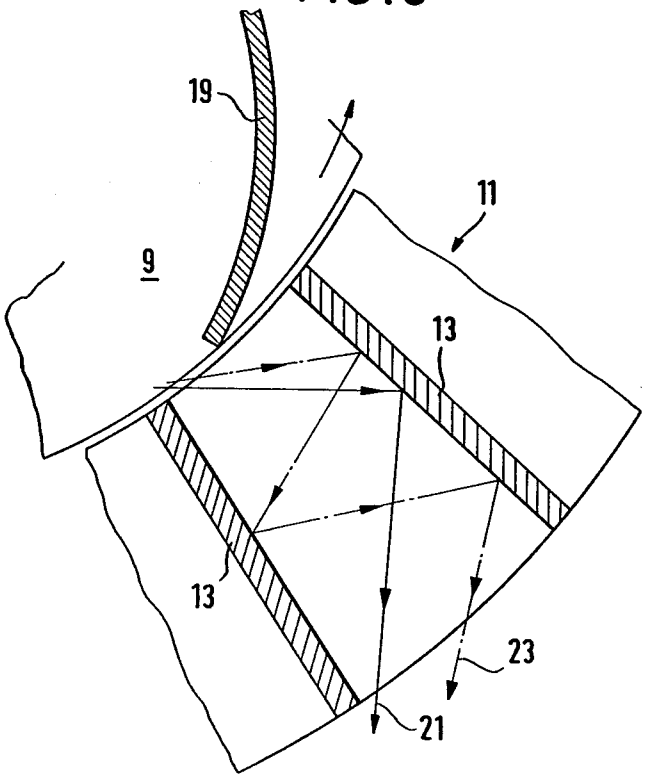

FIG. 3, a larger-scale detail of the transition between the pump impeller and the baffle lamellas.

Figure 4:
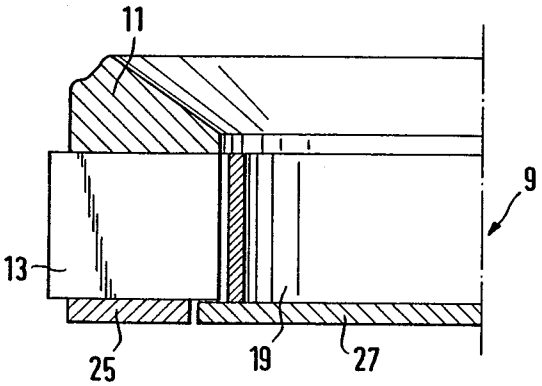

FIG. 4, a larger-scale vertical section through the lamellar ring and pump impeller.

Figure 5:
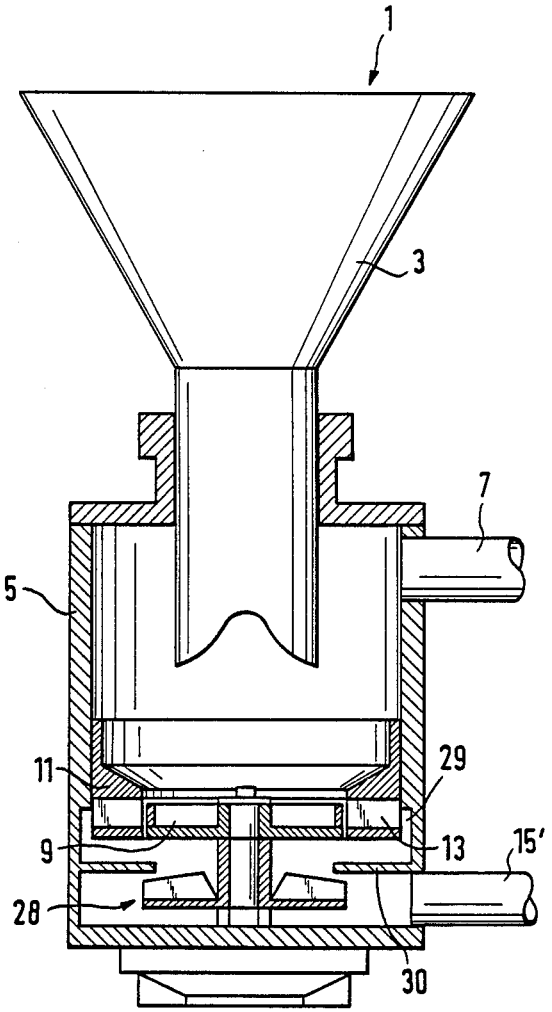

FIG. 5, a vertical section through a further cyclone mixer.

Figure 6:
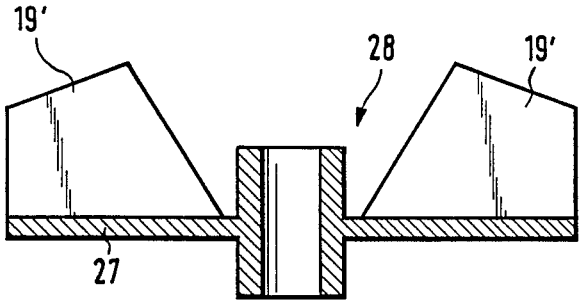

FIG. 6, a sectional view of a pump impeller of the cyclone mixer according to FIG. 5.

Figure 7:
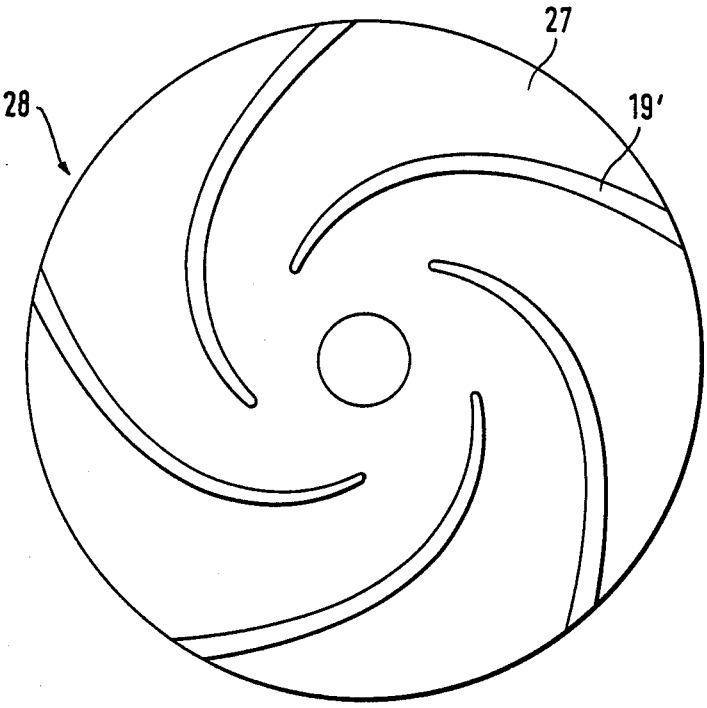

FIG. 7, a plan view of the pump impeller according to FIG. 6.

According to FIG. 1, cyclone mixer 1 has a charging mechanism 3 through which the pulverulent dry product is introduced into the mixing chamber 5 located below the charging mechanism. A suction tube 7 issuing tangentially into the mixing chamber 5 is provided for supplying liquid into the upper area of said chamber. In the lower part of mixing chamber 5 is provided the pump impeller 9, which is surrounded by the dispersing apparatus constructed as the lamellar ring 11. Pump impeller 9 is arranged substantially at the same level as lamellar ring 11, so that the centrifugal flow from the impeller 9 can pass substantially horizontal through the channels of the lamellar ring 11 formed by the baffle lamellas 13. After passing out of the lamellar ring 11, the solution is discharged from the mixing chamber through a common outlet 15. The lamellar ring 11 is fixed to the mixing chamber wall and is consequently fixed with respect to the pump impeller 9. Both the lamellar ring 11 and the pump impeller 9 are interchangeable.

FIG. 2 shows the concentric arrangement of lamellar ring 11 and pump impeller 9 in mixing chamber 5 on a larger scale. In operation, pump impeller 9 rotates counterclockwise, as indicated by arrow 17. The centrifugal flow in the lower region of the mixing chamber 5 is forced outwards into the fixed lamellar ring 11 by the spirally arranged vanes 19 of pump impeller 9. The still not dispersed particles in the flow strike the baffle lamellas 13 and are broken up there. The dispersed solution is brought together on the outer circumference of the lamellar ring and is removed through outlet 15.

FIG. 2 particularly shows that the baffle lamellas 13 are uniformly distributed over the circumference of the lamellar ring 11 and that same extend substantially radially outwards. The inner end portions of the lamellas are positioned immediately adjacent to the radial outer boundary of pump impeller 9. It can be seen that the baffle lamellas 13 are planar. The dispersed solution is removed tangentially from mixing chamber 5 through the outlet connection 15.

FIG. 2 shows two different paths along which particles hurled from the impeller wheel 9 are passed through the lamellar ring, split up during the passage and then removed. For example, a still agglomerated particle strikes the baffle lamella 13 along path 21, is split up and then passes out of the lamellar ring on path 21. As is illustrated by path 23, it is also possible for particles forced in a more tangential direction out of the pump impeller 9 to strike the walls of two adjacent baffle lamellas 13 several times. Hereagain, despite a multiple dispersing action, there is still very good overall throughput through the lamellar ring. The dispersion action can be influenced through varying the reciprocal spacing of two adjacent baffle lamellas 13. According to FIG. 3, this spacing is smaller than the radial extension of the adjacent lamellas 13. This ensures that particles hurled from the pump impeller 9 must strike a baffle lamella at least once.

FIG. 4 shows a special arrangement of the lamellar ring 11 with respect to the pump impeller 9, in that the lamellas 13 of ring 11 extend over the impeller base disc 27 in the area adjacent to impeller 9. The height extension of the baffle lamellas 13 and the vanes 19 of pump impeller 9 is roughly the same. The base ring 25 of lamellar ring 11 is located roughly at the same height as the pump impeller base disc 27. Due to the fact that the baffle lamellas 13 overlap the outer end portion of the pump impeller base disc 27, a continuous transfer of flow from impeller 9 to lamellar ring 11 is ensured.

In the purely diagrammatic longitudinal section of FIG. 5 is shown a further cyclone mixer. It differs from the mixer shown in the previous drawings in that the lamellar ring 13 is followed by a further pump impeller 28, which is located below pump impeller 9, cf particularly FIG. 2 and is coaxial thereto. In the represented embodiment, the two pump impellers 9, 28 are joined in non-rotary manner to one another.

After the dispersed solution has passed through the lamellar ring 13, it passes via an annular recess 29 of mixing chamber 5 on the outer circumference of baffle lamellas 13 and subsequently via a circular supply means 30 from above onto the further pump impeller 28. By means of the latter, the solution is removed outwards via a tangentially issuing discharge connection 15'.

FIGS. 6 and 7 show an exemplified embodiment of the further pump impeller 28. It differs from pump impeller 9 described hereinbefore through the construction of the vanes 19' arranged on base disc 27. From the inner region to the outer edge of base disc 27, the vanes initially rise sharply and then drop slightly. Obviously pump impeller 9 can also be constructed in the represented manner.

I claim:

1. A cyclone mixer for the continuous mixing of pulverulent substances with liquids, said cyclone mixer comprising:

a mixing chamber, a tangential suction tube for liquids located in an upper region of said mixing chamber, a pump impeller located in a lower region of mixing chamber, a charging mechanism for introducing pulverulent substances above an eye of said pump impeller, a dispersing mechanism surrounding said pump impeller, a lower region of a centrifugal flow produced by said pump impeller being guided through said dispersing mechanism into a circular chamber and being removed from said circular chamber through an outlet arranged in said circular chamber, said dispersing mechanism being constructed as a lamellar ring surrounding said pump impeller and which includes baffle lamellas uniformly distributed over its circumference, said baffle lamellas extending substantially radially outward sand having inner end portions located immediately adjacent to a radial outer boundary of said pump impeller.

2. A cyclone mixer for the continuous mixing of pulverulent substances with liquids, said cyclone mixer comprising:

a mixing chamber, a tangential suction tube for liquids located in an upper region of said mixing chamber, a first pump impeller located in a lower region of said mixing chamber, a charging mechanism for introducing pulverulent substances above an eye of said first pump impeller, a dispersing mechanism surrounding said first pump impeller, a lower region of a centrifugal flow produced by said first pump impeller being guided through said dispersing mechanism into a circular chamber and being removed from said circular chamber through an outlet arranged in said circular chamber, said dispersing mechanism being constructed as a lamellar ring surrounding said first pump impeller and which includes baffle lamellas uniformly distributed over its circumference, said lamellas extending substantially radially outwards and having inner end portions located immediately adjacent to a radial outer boundary of said first pump impeller, said outlet being formed as an annular recess on an outer circumference of said circular chamber, said annular recess leading to a second pump impeller arranged coaxially below said first pump impeller, said second pump impeller producing a centrifugal flow guided through a tangential discharge connection.

3. A cyclone mixer according to claim 2, wherein vanes of said second pump impeller are arranged on a base disk.

4. A cyclone mixer according to claim 3, wherein said vanes initially rise sharply and then drop slightly from an inner region to an outer edge of said base disk.

* * * * *